US006553612B1

(12) United States Patent
Dyson et al.

(10) Patent No.: US 6,553,612 B1
(45) Date of Patent: Apr. 29, 2003

(54) VACUUM CLEANER

(75) Inventors: James Dyson, Wiltshire (GB); Geoffrey Michael Burlington, Gloucestershire (GB)

(73) Assignee: Dyson Limited, Malmesbury (GB)

( * ) Notice: Subject to any disclaimer, the term of this patent is extended or adjusted under 35 U.S.C. 154(b) by 0 days.

(21) Appl. No.: 09/868,499

(22) PCT Filed: Dec. 6, 1999

(86) PCT No.: PCT/GB99/04111

§ 371 (c)(1),
(2), (4) Date: Jun. 18, 2001

(87) PCT Pub. No.: WO00/36962

PCT Pub. Date: Jun. 29, 2000

(30) Foreign Application Priority Data

Dec. 18, 1998 (GB) ..... 9827754

(51) Int. Cl.[7] ..... A47L 9/16; A47L 5/00

(52) U.S. Cl. ..... 15/340.1; 15/319; 15/327.7; 15/339; 15/353

(58) Field of Search ..... 15/319, 327.1, 15/340.1, 340.3, 327.7, 353, 339

(56) References Cited

U.S. PATENT DOCUMENTS

| | | | | |
|---|---|---|---|---|
| 2,405,625 A | | 8/1946 | Whiton et al. | |
| 3,320,727 A | * | 5/1967 | Farley et al. | 15/327.1 |
| 4,306,329 A | | 12/1981 | Yokoi | |
| 5,062,870 A | | 11/1991 | Dyson | |
| 5,109,566 A | | 5/1992 | Kobayashi et al. | |
| 5,145,499 A | | 9/1992 | Dyson | |
| 5,483,718 A | | 1/1996 | Blehert et al. | |
| 5,534,762 A | | 7/1996 | Kim | |
| 5,787,545 A | | 8/1998 | Colens | |
| 5,935,279 A | * | 8/1999 | Kilstrom | 15/350 |
| 5,937,477 A | * | 8/1999 | Dyson | 15/327.2 |
| 6,332,239 B1 | * | 12/2001 | Dubos et al. | 15/353 |
| 2002/0069476 A1 | * | 6/2002 | Yung | 15/352 |

FOREIGN PATENT DOCUMENTS

| | | |
|---|---|---|
| EP | 0 636 338 A | 2/1995 |
| EP | 0 803 223 A | 10/1997 |
| WO | WO 97/41451 | 11/1997 |

* cited by examiner

*Primary Examiner*—Terrence R. Till
(74) *Attorney, Agent, or Firm*—Morrison & Foerster LLP

(57) ABSTRACT

The invention provides a vacuum cleaner (10) having a chassis (12), supporting wheels (14) mounted on the chassis (12), drive means (15) connected to the supporting wheels (14) for driving the supporting wheels (14) and a control mechanism for controlling the drive means (15) so as to guide the vacuum cleaner (10) across a surface to be cleaned. A cleaner head (22) having a dirty air inlet (24) facing the surface to be cleaned is mounted on the chassis (12) and separating apparatus (52) is supported by the chassis (12) and communicates with the cleaner head (22) for separating dirt and dust from an airflow entering the vacuum cleaner (10) by way of the dirty air inlet (24). The separating apparatus (52) comprises at least one cyclone(54, 56). This type of separating apparatus is not prone to clogging and therefore the pick-up capability of the cleaner (10) is maintained at a high standard.

17 Claims, 8 Drawing Sheets

VACUUM CLEANER

This application claims priority to International Application No. PCT/GB99/04111 filed Dec. 6, 1999, which was published on Jun. 29, 2000.

FIELD OF THE INVENTION

The invention relates to a vacuum cleaner. Particularly, the invention relates to a vacuum cleaner having a chassis, supporting wheels mounted on the chassis, drive means connected to the supporting wheels for driving the supporting wheels, a control mechanism for controlling the drive means so as to guide the vacuum cleaner across a surface to be cleaned, a cleaner head having a dirty air inlet facing the surface to be cleaned, and separating apparatus supported by the chassis and communicating with the cleaner head for separating dirt and dust from an airflow entering the vacuum cleaner by way of the dirty air inlet. Such a vacuum cleaner is more conveniently termed a robotic vacuum cleaner.

BACKGROUND OF THE INVENTION

Robotic vacuum cleaners are known. The control mechanism normally includes sensors for detecting obstacles and walls so that the vacuum cleaner is capable of guiding itself around a room so as to vacuum the carpet or other floor covering without human intervention. Examples of robotic vacuum cleaners of this general type are shown and described in, inter alia, EP0803224A, U.S. Pat. No. 5,534,762, W097/41451, U.S. Pat. No. 5,109,566 and U.S. Pat. No. 5,787,545. In the prior art cleaners, the separating apparatus by means of which the dirt and dust is separated from the airflow consists of a bag-type filter or an equivalent container-type filter. The difficulty with arrangements such as these is that, as the bag fills, it becomes clogged with dirt and dust so that the ability of the cleaner to pick up dirt and dust reduces with time. This means that the performance of the cleaner does not remain at a constant standard during operation and may require human intervention to compensate for the reduction in performance. This defeats the object of a robotic vacuum cleaner.

It is an object of the present invention to provide a robotic vacuum cleaner which does not clog as the dirt and dust are separated from the airflow. It is another object of the invention to provide a robotic vacuum cleaner whose pick-up capability does not diminish over time. It is a further object of the invention is to provide a robotic vacuum cleaner which is simple to use and effective in its operation without being prohibitively expensive to manufacture.

SUMMARY OF THE INVENTION

The invention provides a vacuum cleaner having a chassis, supporting wheels mounted on the chassis, drive means connected to the supporting wheels for driving the supporting wheels, a control mechanism for controlling the drive means so as to guide the vacuum cleaner across a surface to be cleaned, a cleaner head having a dirty air inlet facing the surface to be cleaned, and separating apparatus supported by the chassis and communicating with the cleaner head for separating dirt and dust from an airflow entering the vacuum cleaner by way of the dirty air inlet, characterised in that the separating apparatus comprises at least one cyclone.

Providing cyclonic separating apparatus on a robotic vacuum cleaner removes the problem of the bag- or container-type filters clogging with use. In cyclonic separating apparatus, clogging does not occur and therefore there is no decrease in the pick-up capability which maintains the suction at the dirty air inlet. The performance of the cleaner remains constant because the suction developed at the dirty air inlet is maintained at a constant level.

DETAILED DESCRIPTION OF THE INVENTION

Preferably, the separating apparatus comprises two cyclones, the upstream cyclone being adapted to remove comparatively large dirt and dust particles from the airflow and the downstream cyclone being adapted to remove comparatively small dirt and dust particles from the airflow. This arrangement allows the downstream cyclone to operate under optimum conditions because the larger dirt and dust particles have already been removed from the airflow before it reaches the downstream, high efficiency cyclone. It is also preferred if the cyclones are arranged concentrically, more preferably one inside the other, so as to provide a compact and convenient arrangement. In this case, the outer, low efficiency cyclone can be generally cylindrical in shape and the inner, high efficiency cyclone can be frusto-conical in shape.

Preferably, the separating apparatus is supported on the chassis with the longitudinal axis of the separating apparatus lying in a substantially horizontal position. This minimises the height of the cleaner.

The cyclonic separating apparatus preferably includes a removable bin or collecting chamber in which, in use, the dirt and dust separated from the airflow is collected. The bin or collecting chamber is removable to allow convenient emptying of the vacuum cleaner of dirt and dust. It is preferable if the bin or collecting chamber is transparent or translucent so that the interior of the bin or collecting chamber can be periodically inspected. The user can then see when the bin needs to be emptied.

BRIEF DESCRIPTION OF THE DRAWINGS

An embodiment of the invention will now be described with reference to the accompanying drawings, wherein.

Figure 1:
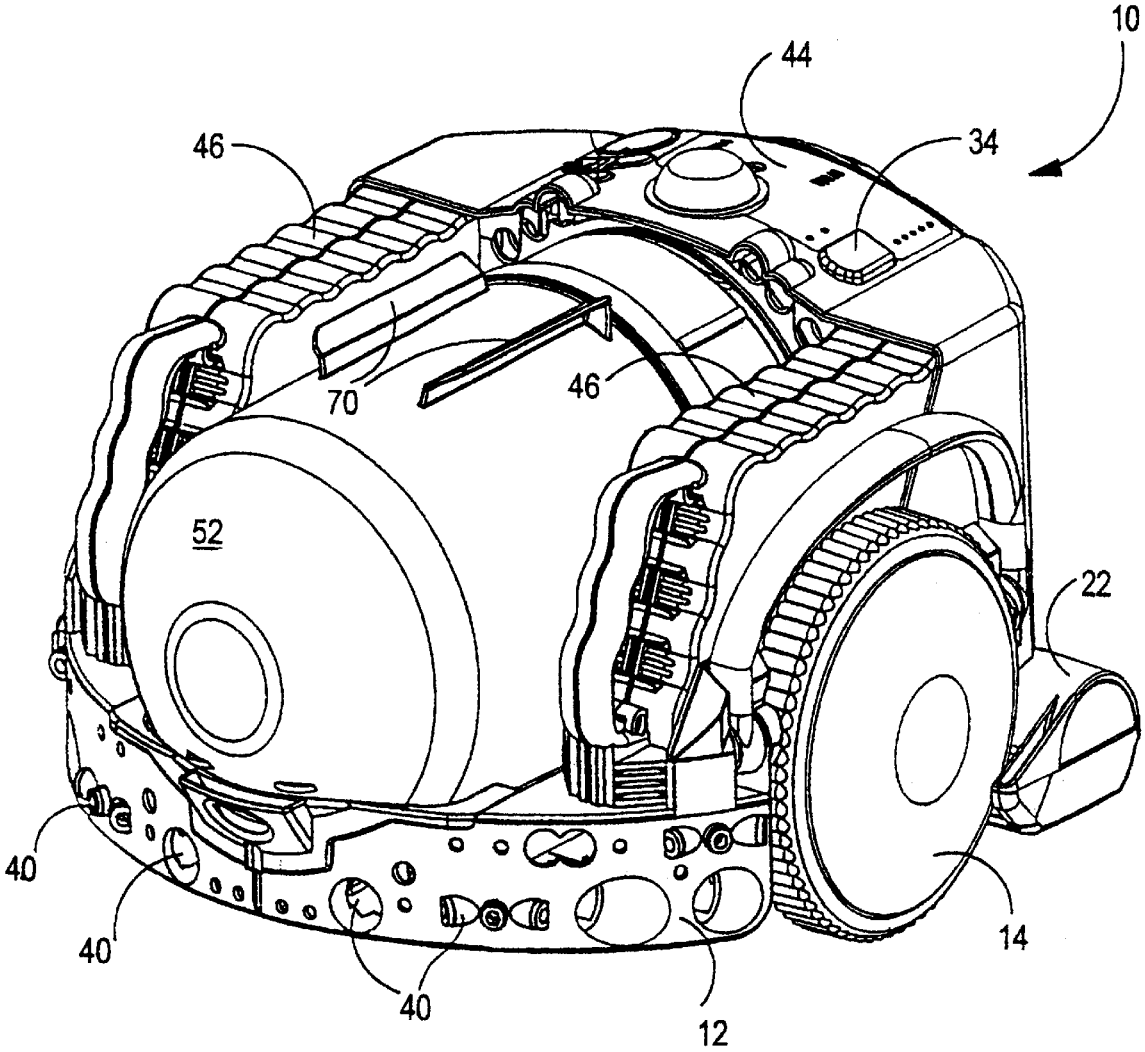
FIG. 1 is a perspective view of a vacuum cleaner according to the invention.

The vacuum cleaner 10 shown in the drawings has a supporting chassis 12 which is generally circular in shape and is supported on two driven wheels 14 and a castor wheel 16. The chassis 12 is preferably manufactured from high-strength moulded plastics material, such as ABS, but can equally be made from metal such as aluminium or steel. The chassis 12 provides support for the components of the cleaner 10 which will be described below. The driven wheels 14 are arranged at either end of a diameter of the chassis 12, the diameter lying perpendicular to the longitudinal axis 18 of the cleaner 10. Each driven wheel 14 is moulded from a high-strength plastics material and carries a comparatively soft, ridged band around its circumference to enhance the grip of the wheel 14 when the cleaner 10 is traversing a smooth floor. The driven wheels 14 are mounted independently of one another via support bearings (not shown) and each driven wheel 14 is connected directly to a motor 15 which is capable of driving the respective wheel 14 in either a forward direction or a reverse direction. By driving both wheels 14 forward at the same speed, the cleaner 10 can be driven in a forward direction. By driving both wheels 14 in a reverse direction at the same speed, the cleaner 10 can be driven in a backward direction. By driving the wheels 14 in opposite directions, the cleaner 10 can be made to rotate about its own central axis so as to effect a turning manoeuvre. The aforementioned method of driving a vehicle is well known and will not therefore be described any further here.

Figure 4:
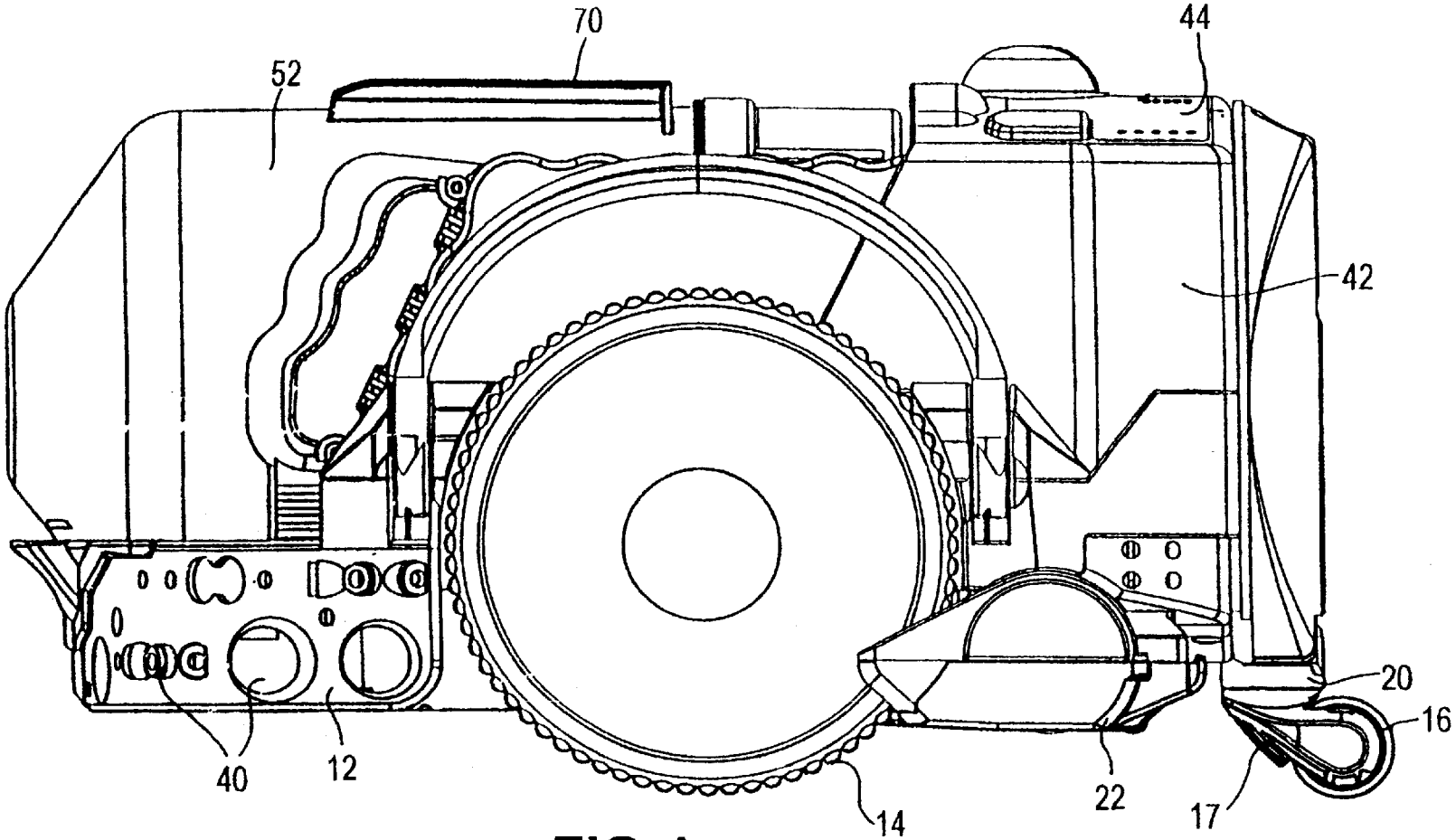
FIG. 4 is a side view of the vacuum cleaner of FIG. 1.

The castor wheel 16 is significantly smaller in diameter than the driven wheels 14 as can be seen from, for example, FIG. 4. The castor wheel 16 is not driven and merely series to support the chassis 12 at the rear of the cleaner 10. The location of the castor wheel 16 at the trailing edge of the chassis 12, and the fact that the castor wheel 16 is swivellingly mounted on the chassis by means of a swivel joint 20, allows the castor wheel 16 to trail behind the cleaner 10 in a manner which does not hinder the manoeuvrability of the cleaner 10 whilst it is being driven by way of the driven wheels 14. The swivel joint 20 is most clearly shown in FIG. 6. The castor wheel 16 is fixedly attached to an upwardly extending cylindrical member 20*a* which is received by an annular housing 20*b* to allow free rotational movement of the cylindrical member 20*a* therewithin. This type of arrangement is well known. The castor wheel 16 can be made from a moulded plastics material or can be formed from another synthetic material such as Nylon.

Mounted on the underside of the chassis 12 is a cleaner head 22 which includes a suction opening 24 facing the surface on which the cleaner 10 is supported. The suction opening 24 is essentially rectangular and extends across the majority of the width of the cleaner head 22. A brush bar 26 is rotatably mounted in the suction opening 24 and a motor 28 is mounted on the cleaner head 22 for driving the brush bar 26 by way of a drive belt (not shown) extending between a shaft of the motor 28 and the brush bar 26.

The cleaner head 22 is mounted on the chassis 12 in such a way that the cleaner head 22 is able to float on the surface to be cleaned. This is achieved in this embodiment in that the cleaner head 22 is pivotally connected to an arm (not shown) which in turn is pivotally connected to the underside of the chassis 12. The double articulation of the connection between the cleaner head 22 and the chassis 12 allows the cleaner head to move freely in a vertical direction with respect to the chassis 12. This enables the cleaner head to climb over small obstacles such as books, magazines, rug edges, etc. Obstacles of up to approximately 25 mm in height can be traversed in this way. A flexible connection 30 (see FIG. 7) is located between a rear portion of the cleaner head 22 and an inlet port 32 (see also FIG. 7) located in the chassis 12. The flexible connection 30 consists of a rolling seal, one end of which is sealingly attached to the upstream mouth of the inlet port 32 and the other end of which is sealingly attached to the cleaner head 22. When the cleaner head 22 moves upwardly with respect to the chassis 12, the rolling seal 30 distorts or crumples to accommodate the upward movement of the cleaner head 22. When the cleaner head 22 moves downwardly with respect to the chassis 12, the rolling seal 30 unfolds or extends into an extended position to accommodate the downward movement.

In order to assist the cleaner head 22 to move vertically upwards when an obstacle is encountered, forwardly projecting ramps 36 are provided at the front edge of the cleaner head 22. In the event that an obstacle is encountered, the obstacle will initially abut against the ramps 36 and the inclination of the ramps will then lift the cleaner head 22 over the obstacle in question so as to avoid the cleaner 10 from becoming lodged against the obstacle. The cleaner head 22 is shown in a lowered position in FIG. 6 and in a raised position in FIG. 4. The castor wheel 16 also includes a ramped portion 17 which provides additional assistance when the cleaner 10 encounters an obstacle and is required to climb over it. In this way, the castor wheel 16 will not become lodged against the obstacle after the cleaner head 22 has climbed over it.

Figure 2:
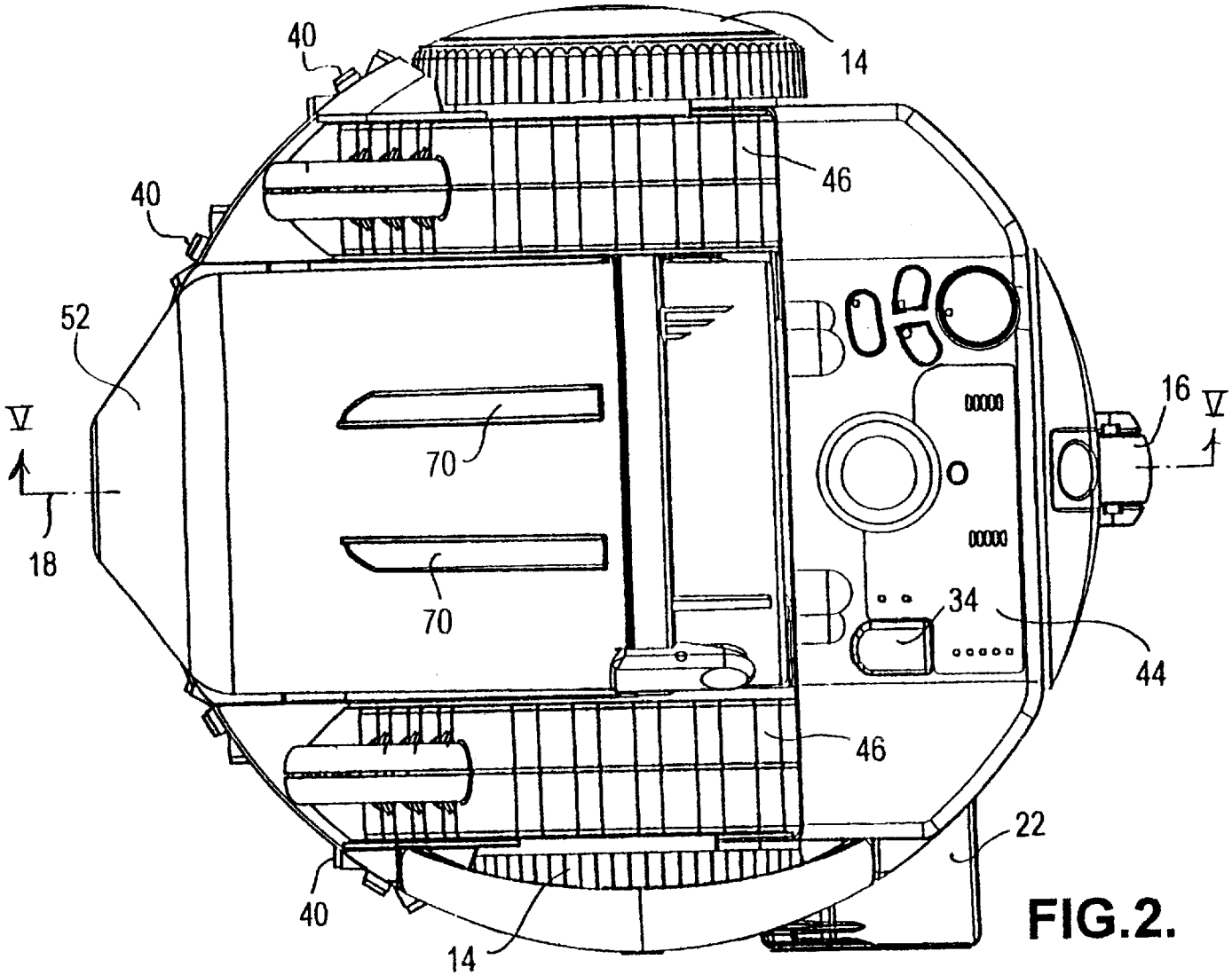
FIG. 2 is a plan view of the vacuum cleaner of FIG. 1.
Figure 3:
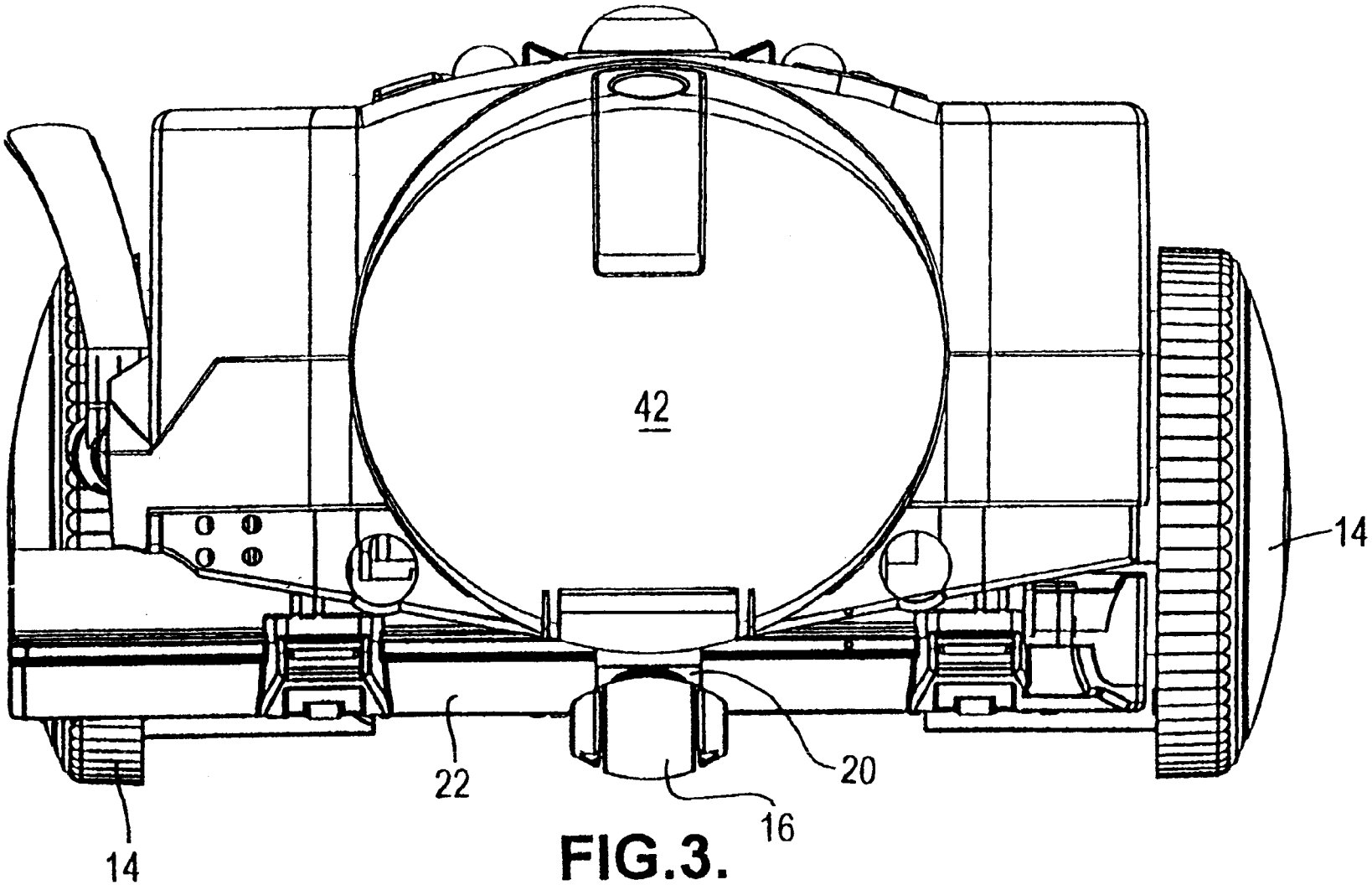
FIG. 3 is a rear view of the vacuum cleaner of FIG. 1.
Figure 5:
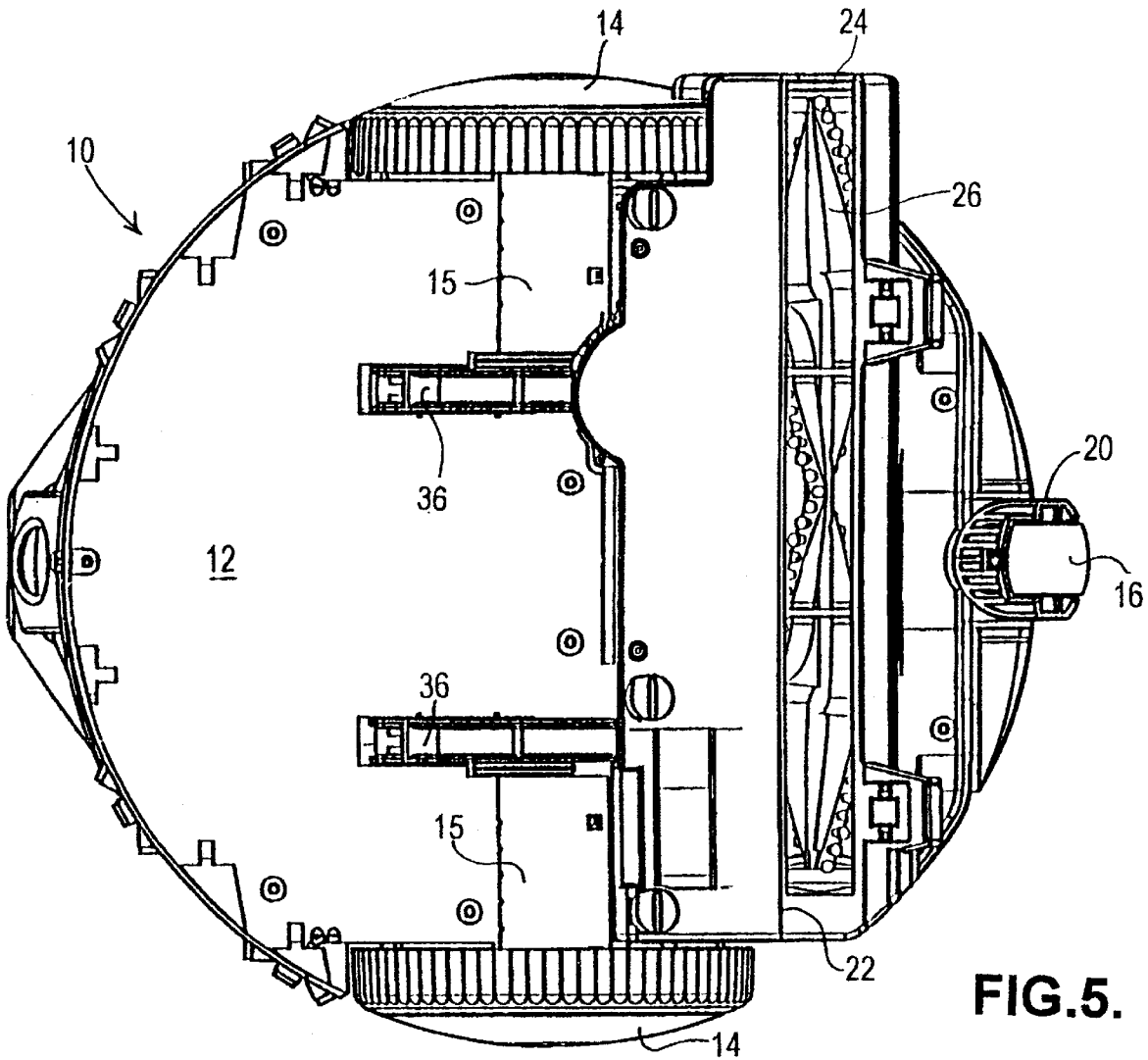
FIG. 5 is an underneath view of the vacuum cleaner of FIG. 1.

As can be seen from FIGS. 2 and 5, the cleaner head 22 is asymmetrically mounted on the chassis 12 so that one side of the cleaner head 22 protrudes beyond the general circumference of the chassis 12. This allows the cleaner 10 to clean up to the edge of a room on the side of the cleaner 10 on which the cleaner head 22 protrudes.

The chassis 12 carries a plurality of sensors 40 which are designed and arranged to detect obstacles in the path of the cleaner 10 and its proximity to, for example, a wall or other boundary such as a piece of furniture. The sensors 40 comprise several ultra-sonic sensors and several infra-red sensors. The array illustrated in FIGS. 1 and 4 is not intended to be limitative and the arrangement of the sensors does not form part of the present invention. Suffice it to say that the vacuum cleaner 10 carries sufficient sensors and detectors 40 to enable the cleaner 10 to guide itself or to be guided around a predefined area so that the said area can be cleaned. Control software, comprising navigation controls and steering devices, is housed within a housing 42 located beneath a control panel 44 or elsewhere within the cleaner 10. Battery packs 46 are mounted on the chassis 12 inwardly of the driven wheels 14 to provide power to the motors for driving the wheels 14 and to the control software. The battery packs 46 are removable to allow them to be transferred to a battery charger (not shown).

The vacuum cleaner 10 also includes a motor and fan unit 50 supported on the chassis 12 for drawing dirty air into the vacuum cleaner 10 via the suction opening 24 in the cleaner head 22. The chassis 12 also carries a cyclonic separator 52 for separating dirt and dust from the air drawn into the cleaner 10. The features of the cyclonic separator 52 are best seen from FIGS. 6 and 7. The cyclonic separator 52 comprises an outer cyclone 54 and an inner cyclone 56 arranged concentrically therewith, both cyclones 54,56 having their coaxial axes lying horizontally. The outer cyclone 54 comprises an entry portion 58 which communicates directly with the inlet port 32 as shown in FIG. 7. The inlet port 32 is arranged to be tangential to the entry portion 58 which is cylindrical and has an end wall 60 which is generally helical. The entry portion 58 opens directly into a cylindrical bin 62 having an outer wall 64 whose diameter is the same as that of the entry portion 58. The cylindrical bin 62 is made from a transparent plastics material to allow a user to view the interior of the outer cyclone 54. The end of the bin 62 remote from the entry portion 58 is frusto-conical in shape and closed. A locating ring 66 is formed integrally with the end of the bin at a distance from the outer wall 64 thereof and a dust ring 68 is also formed integrally with the end of the bin 62 inwardly of the locating ring 66. Located on the outer surface of the bin 62 are two opposed gripper portions 70 which are adapted to assist a user to remove the separator 52 from the chassis 12 for emptying purposes. Specifically, the gripper portions 70 are moulded integrally with the transparent bin 62 and extend upwardly and outwardly from the outer wall 64 so as to form an undercut profile as shown in FIG. 1.

The inner cyclone 56 is formed by a partially-cylindrical, partially-frusto-conical cyclone body 72 which is rigidly attached to the end face of the entry portion 58. The cyclone body 72 lies along the longitudinal axis of the transparent bin 62 and extends almost to the end face thereof so that the distal end 72*a* of the cyclone body 72 is surrounded by the dust ring 68. The gap between the cone opening at the distal end 72*a* of the cyclone body 72 and the end face of the bin 62 is preferably less than 8 mm. A fine dust collector 74 is located in the bin 62 and is supported by the locating ring 66 at one end thereof. The fine dust collector 74 is supported at the other end thereof by the cyclone body 72. Seals 76 are provided between the fine dust collector 74 and the respective support at either end. The fine dust collector 74 has a first cylindrical portion 74*a* adapted to be received within the locating ring 66, and a second cylindrical portion 74*b* having a smaller diameter than the first cylindrical portion 74*a*. The cylindrical portions 74*a*, 74*b* are joined by a frusto-conical portion 74*c* which is integrally moulded therewith. A single fin or baffle 78 is also moulded integrally with the fine dust collector 74 and extends radially outwardly from the second cylindrical portion 74*b* and from the frusto-conical portion 74*b*. The outer edge of the fin 78 is aligned with the first cylindrical portion 74*a* and the edge of the fin 78 remote from the first cylindrical portion 74*a* is essentially parallel to the frusto-conical portion 74*b*. The fin 78 extends vertically upwardly from the fine dust collector 74.

A shroud 80 is located between the first and second cyclones 54, 56. The shroud 80 is cylindrical in shape and is supported at one end by the entry portion 58 and by the cyclone body 72 of the inner cyclone 56 at the other end. As is known, the shroud 80 has perforations 82 extending therethrough and a lip 83 projecting from the end of the shroud 80 remote from the entry portion 58. A channel 84 is formed between the shroud 80 and the outer surface of the cyclone body 72, which channel 84 communicates with an entry port 86 leading to the interior of the inner cyclone 56 in a manner which forces the incoming airflow to adopt a swirling, helical path. This is achieved by means of a tangential or scroll entry into the inner cyclone 56 as can be seen from FIG. 7. A vortex finder (not shown) is located centrally of the larger end of the inner cyclone 56 to conduct air out of the cyclonic separator 52 after separation has taken place. The exiting air is conducted past the motor and fan unit 50 so that the motor can be cooled before the air is expelled to atmosphere. Additionally, a post-motor filter (not shown) can be provided downstream of the motor and fan unit 50 in order to further minimise the risk of emissions into the atmosphere from the vacuum cleaner 10.

The entire cyclonic separator 52 is releasable from the chassis 12 in order to allow emptying of the outer and inner cyclones 54, 56. A hooked catch (not shown) is provided adjacent the inlet port 32 by means of which the cyclonic separator 52 is held in position when the cleaner 10 is in use. When the hooked catch is released (by manual pressing of a button 34 located in the control panel 44), the cycionic separator 52 can be lifted away from the chassis 12 by means of the gripper portions 70. The bin 62 can then be released from the entry portion 58 (which carries with it the shroud 80 and the inner cyclone body 72) to facilitate the emptying thereof.

Figure 6:
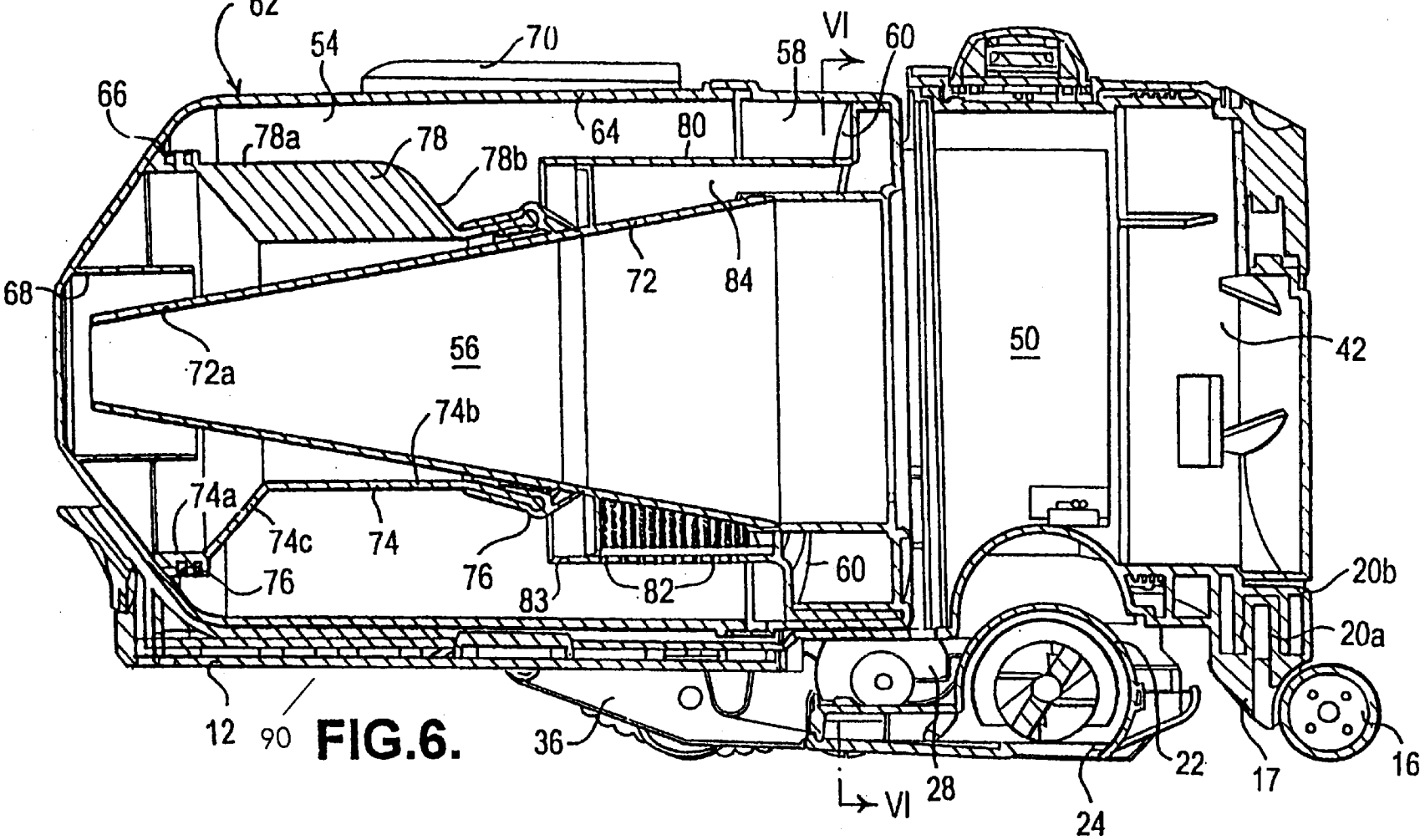
FIG. 6 is a sectional view taken along the line V—V of FIG. 2.
Figure 7:
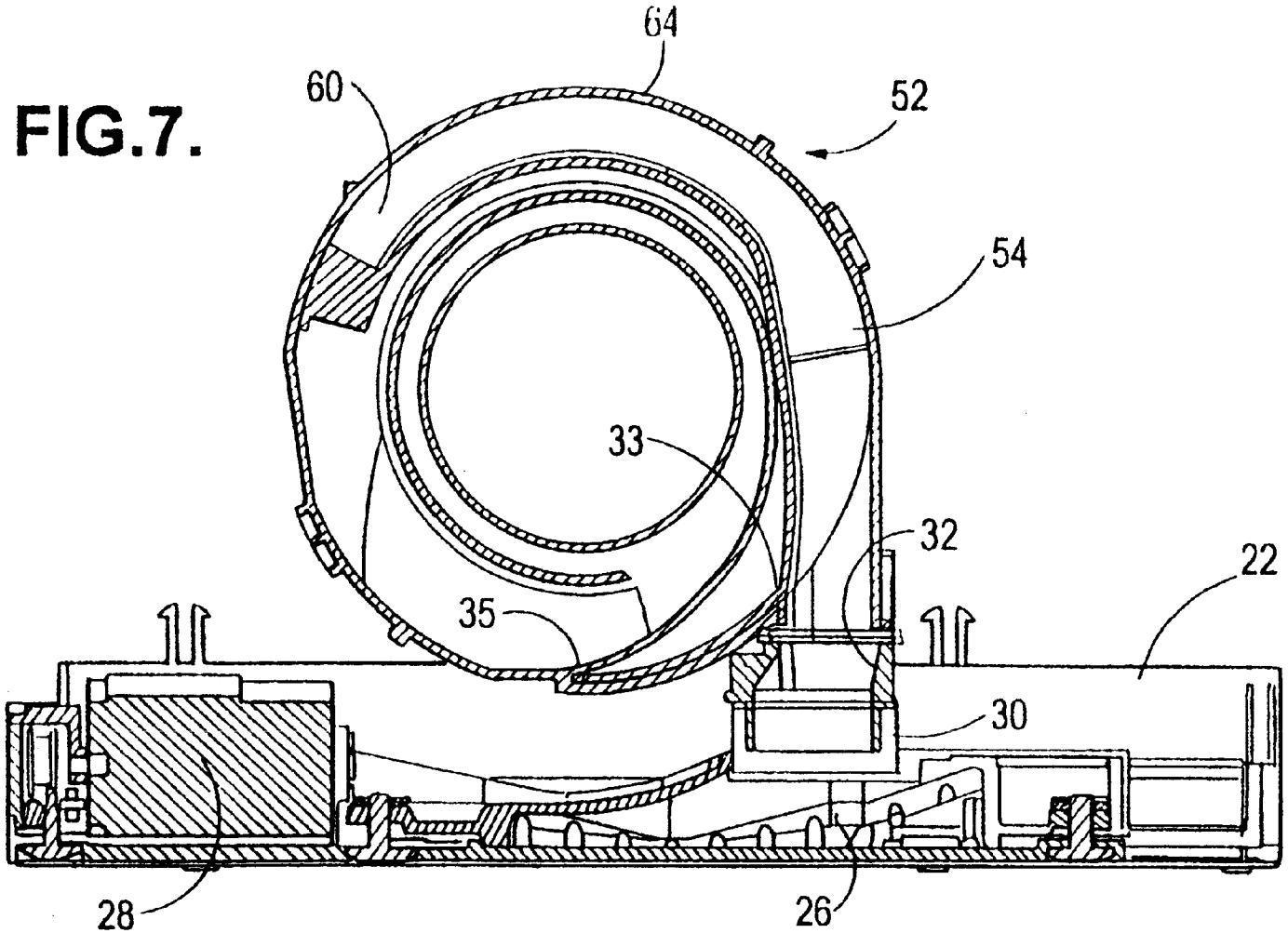
FIG. 7 is a sectional view taken along the line VI—VI of FIG. 6 showing only the cleaner head and the cyclonic separator of the vacuum cleaner of FIG. 1.
Figure 8:
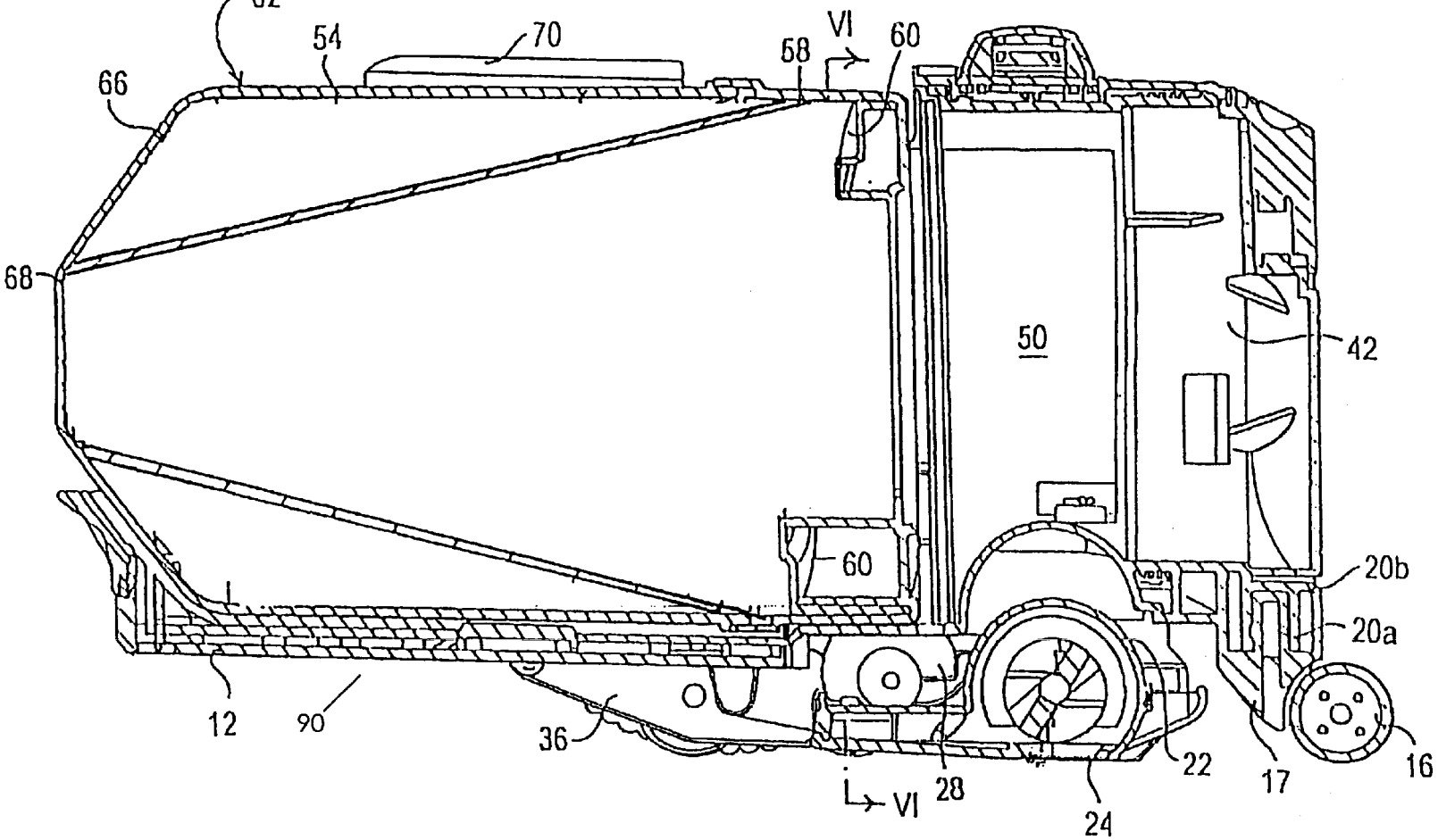
FIG. 8 is a sectional view of a vacuum cleaner with a single frusto-conical cyclone according to an embodiment of the invention.

Electronic circuitry for controlling operation of the robotic vacuum cleaner is housed in a lower portion of chassis 12 (see region 90, FIG. 6). Other circuitry is located beneath control panel 44. The circuitry is electrically shielded from electrostatic fields generated by the cyclone by positioning the circuitry between sheets of electrically conductive material. A first sheet underlies the bin 62. Circuitry is mounted beneath this first sheet and a second sheet lies on the base of the chassis, underneath the circuitry. The sheets are electrically grounded.

The vacuum cleaner 10 described above operates in the following manner. In order for the cleaner 10 to traverse the area to be cleaned, the wheels 14 are driven by the motors 15 which, in turn, are powered by the batteries 46. The direction of movement of the cleaner 10 is determined by the control software which communicates with the sensors 40 which are designed to detect any obstacles in the path of the cleaner 10 so as to navigate the cleaner 10 around the area to be cleaned. Methodologies and control systems for navigating a robotic vacuum cleaner around a room or other area are well documented elsewhere and do not form part of the inventive concept of this invention. Any of the known methodologies or systems could be implemented here to provide a suitable navigation system.

The batteries 46 also provide power to operate the motor and fan unit 50 to draw air into the cleaner 10 via the suction opening 24 in the cleaner head 22. The motor 28 is also driven by the batteries 46 so that the brush bar 26 is rotated in order to achieve good pick-up, particularly when the cleaner 10 is to be used to clean a carpet. The dirty air is drawn into the cleaner head 22 and conducted to the cyclonic separator 52 via the telescopic conduit 30 and the inlet port 32. The dirty air then enters the entry portion 58 in a tangential manner and adopts a helical path by virtue of the shape of the helical wall 60. The air then spirals down the interior of the outer wall 64 of the bin 62 during which motion any relatively large dirt and fluff particles are separated from the airflow. The separated dirt and fluff particles collect in the end of the bin 62 remote from the entry portion 58. The fin 78 discourages uneven accumulation of dirt and fluff particles and helps to distribute the dirt and fluff collected around the end of the bin 62 in a relatively even manner.

The airflow from which dirt and larger fluff particles has been separated moves inwardly away from the outer wall 64 of the bin 62 and travels back along the exterior wall of the fine dust collector 74 towards the shroud 80. The presence of the shroud 80 also helps to prevent larger particles and fluff traveling from the outer cyclone 54 into the inner cyclone 56, as is known. The air from which comparatively large particles and dirt has been separated then passes through the shroud 80 and travels along the channel between the shroud 80 and the outer surface of the inner cyclone body 72 until it reaches the inlet port 86 to the inner cyclone 56. The air then enters the inner cyclone 56 in a helical manner and follows a spiral path around the inner surface of the cyclone body 72. Because of the frusto-conical shape of the cyclone body 72, the speed of the airflow increases to very high values at which the fine dirt and dust still entrained within the airflow is separated therefrom. The fine dirt and dust separated in the inner cyclone 56 is collected in the fine dust collector 74 outwardly of the dust ring 68. The dust ring 68 discourages re-entrainment of the separated dirt and dust back into the airflow.

When the fine dirt and dust has been separated from the airflow, the cleaned air exits the cyclonic separator via the vortex finder (not shown). The air is passed over or around the motor and fan unit 50 in order to cool the motor before it is expelled into the atmosphere.

The provision of cyclonic separating apparatus on a robotic vacuum cleaner avoids the need to make use of bag-type filters to separate the dirt or dust from the airflow. This in turn avoids the inevitable clogging of bag-type filters which can result in a reduction in pickup (and therefore reduced efficacy in cleaning). The invention herein described is not concerned with the specific means by which the cleaner is propelled across a surface to be cleaned, nor with the specific means by which the cleaner avoids contact with obstacles or obstructions. Indeed, the cleaner could be powered via a mains supply using a cable if desired, although it is preferred that the cleaner be operated in a cordless manner. The nature and arrangement of the sensors described above are also immaterial and can be replaced by equivalent arrangements which will be apparent to a skilled reader. It will be understood that the means by which the batteries providing power to the cleaner are charged is also immaterial to the invention, as is the arrangement by which they are attached to and released from the cleaner. The same goes for the exact design and configuration of the cleaner head and the manner by which it is mounted on the chassis. All of these features are to be regarded as non-essential to the central concept of providing a robotic or autonomous vacuum cleaner with cyclonic separating means in the manner described above.

What is claimed is:

1. A vacuum cleaner, comprising a chassis, supporting wheels mounted on the chassis, a drive connected to the supporting wheels for driving the supporting wheels, a control mechanism for controlling the drive so as to guide the vacuum cleaner across a surface to be cleaned, a cleaner head having a dirty air inlet facing the surface to be cleaned, and a separating apparatus supported by the chassis and communicating with the cleaner head for separating dirt and dust from an airflow entering the vacuum cleaner by way of the dirty air inlet, wherein the separating apparatus comprises at least one cyclone having a cyclone body with a longitudinal axis and wherein the separating apparatus is supported on the chassis with the longitudinal axis of the cyclone body lying in a substantially horizontal position.

2. A vacuum cleaner as claimed in claim 1, wherein the separating apparatus comprises an upstream cyclone and a downstream cyclone arranged in series.

3. A vacuum cleaner as claimed in claim 2, wherein the upstream cyclone is adapted to remove comparatively large-sized dirt and dust particles from the airflow and the downstream cyclone is adapted to remove comparatively small-sized dirt and dust particles from the airflow.

4. A vacuum cleaner as claimed in claim 2, wherein the cyclones are arranged concentrically.

5. A vacuum cleaner as claimed in claim 2, wherein the upstream cyclone is generally cylindrical in shape.

6. A vacuum cleaner as claimed in claim 2, wherein the downstream cyclone is frusto-conical in shape.

7. A vacuum cleaner as claimed in claim 2, wherein the downstream cyclone is arranged inside the upstream cyclone.

8. A vacuum cleaner as claimed in claim 1, wherein the separating apparatus comprises a single cyclone which is frusto-conical in shape.

9. A vacuum cleaner as claimed in claim 1, wherein the separating apparatus comprises a removable bin in which, in use, dirt and dust is collected.

10. A vacuum cleaner as claimed in claim 9, wherein the removable bin is transparent or translucent.

11. A vacuum cleaner as claimed in claim 9, wherein the removable bin forms an external part of the vacuum cleaner.

12. A vacuum cleaner as claimed in claim 1, wherein the cleaner head is connected to the chassis by means of an arm which is pivotally connected to the chassis at a first end and pivotally connected to the cleaner head at a second end.

13. A vacuum cleaner as claimed in claim 1, further comprising at least one power pack that is carried by the chassis and is connected to the drive and the control mechanism.

14. A vacuum cleaner as claimed in claim 1, further comprising electrical shielding for shielding the control mechanism from electrostatic fields generated by the cyclone.

15. A vacuum cleaner as claimed in claim 1, further comprising an inlet to the separating apparatus located directly above an outlet of the cleaner head.

16. A vacuum cleaner comprising a chassis, supporting wheels mounted on the chassis, a drive connected to the supporting wheels for driving the supporting wheels, a control mechanism for controlling the drive so as to guide the vacuum cleaner across a surface to be cleaned, a cleaner head having a dirty air inlet facing the surface to be cleaned, and a separating apparatus supported by the chassis and communicating with the cleaner head for separating dirt and dust from an airflow entering the vacuum cleaner by way of the dirty air inlet, wherein the separating apparatus comprises at least one cyclone and wherein the control mechanism is electrically shielded from electrostatic fields generated by the cyclone.

17. A vacuum cleaner comprising a chassis, supporting wheels mounted on the chassis, a drive connected to the supporting wheels for driving the supporting wheels, a control mechanism for controlling the drive so as to guide the vacuum cleaner across a surface to be cleaned, a cleaner head having a dirty air inlet facing the surface to be cleaned, and a separating apparatus supported by the chassis and communicating with the cleaner head for separating dirt and dust from an airflow entering the vacuum cleaner by way of the dirty air inlet, wherein the separating apparatus comprises at least one cyclone and a removable bin in which, in use, dirt and dust is collected, and wherein the removable bin is transparent or translucent.

* * * * *